US006465052B1

(12) United States Patent
Wu

(10) Patent No.: US 6,465,052 B1
(45) Date of Patent: Oct. 15, 2002

(54) METHOD FOR PRODUCTION OF NANO-POROUS COATINGS

(75) Inventor: L. W. Wu, Auburn, AL (US)

(73) Assignee: Nanotek Instruments, Inc., Opelika, AL (US)

( * ) Notice: Subject to any disclaimer, the term of this patent is extended or adjusted under 35 U.S.C. 154(b) by 0 days.

(21) Appl. No.: 09/996,325

(22) Filed: Nov. 30, 2001

(51) Int. Cl.[7] ..... H05H 1/32

(52) U.S. Cl. ..... 427/540; 427/201; 427/255.25; 427/255.28; 427/255.29; 427/255.38; 427/255.39; 427/255.394; 427/561; 427/562; 427/564; 427/570; 427/576; 427/580

(58) Field of Search ..... 427/540, 201, 427/255.25, 255.28, 255.29, 255.38, 255.39, 255.394, 561, 562, 564, 570, 576, 580

(56) References Cited

U.S. PATENT DOCUMENTS

| | | | |
|---|---|---|---|
| 4,095,081 | A | 6/1978 | Ashman |
| 4,668,852 | A | 5/1987 | Fox et al. |
| 5,581,091 | A | 12/1996 | Moskovits et al. |
| 5,594,263 | A | 1/1997 | Bedard et al. |
| 5,622,684 | A | 4/1997 | Pinnavaia et al. |
| 5,686,031 | A | 11/1997 | Coronado et al. |
| 5,849,215 | A | 12/1998 | Gin et al. |
| 5,922,299 | A | 7/1999 | Bruinsma et al. |
| 5,964,405 | A | 10/1999 | Benary et al. |
| 6,080,219 | A | 6/2000 | Jha et al. |
| 6,083,614 | A | 7/2000 | Gordeev et al. |
| 6,156,812 | A | 12/2000 | Lau et al. |
| 6,204,202 | B1 | 3/2001 | Leung et al. |
| 6,214,746 | B1 | 4/2001 | Leung et al. |
| 6,270,846 | B1 | 8/2001 | Brinker et al. |

OTHER PUBLICATIONS

Velev, et al., "Porous silica via colloidal crystallization," Nature, Oct. 1997, pp. 447–448, vol. 389.

Kulinowsky, et al., "Porous metals from colloidal templates," Advanced Materials, 2000, pp. 833, vol. 12 (No month avail.).

*Primary Examiner*—Bernard Pianalto

(57) ABSTRACT

A method for producing a nano-porous coating onto a substrate, including the steps of: (a) operating a twin-wire arc nozzle to heat and at least partially vaporize two wires of a metal for providing a stream of nanometer-sized vapor clusters of the metal into a chamber in which the substrate is disposed; (b) injecting a stream of reactive gas into the chamber to impinge upon the stream of metal vapor clusters and exothermically react therewith to produce substantially nanometer-sized metal compound or ceramic clusters; (c) operating heat treatment devices to heat treat the metal compound or ceramic clusters so that a non-zero proportion of the clusters is in a solid state when impinging upon the substrate; and (d) directing the metal compound or ceramic clusters to impinge and deposit onto the substrate for forming the nano-porous coating.

15 Claims, 4 Drawing Sheets

METHOD FOR PRODUCTION OF NANO-POROUS COATINGS

FIELD OF THE INVENTION

The present invention relates to a method for producing a nano-porous coating on a substrate. In particular, the invention provides a method that is capable of mass-producing coatings for sensor, membrane, and electrode applications.

BACKGROUND OF THE INVENTION

Porous solids have been utilized in a wide range of applications, including membranes, catalysts, sensor, energy storage (electrodes), photonic crystals, microelectronic device substrate, absorbents, light-weight structural materials, and thermal, acoustical and electrical insulators. These solid materials are usually classified according to their predominant pore sizes: (i) micro-porous solids, with pore sizes <1.0 nm; (ii) macro-porous solids, with pore sizes exceeding 50 nm (normally up to 500 $\mu$m); and (iii) meso-porous solids, with pore sizes intermediate between 1.0 and 50 nm. The term "nano-porous solid" means a solid that contains essentially nanometer-scaled pores (1–1,000 $\mu$m) and, therefore, covers "meso-porous solids" and the lower-end of "macro-porous solids".

A number of methods have previously been used to fabricate macro- or meso-porous inorganic films. Meso-porous solids can be obtained by using surfactant arrays or emulsion droplets as templates. Latex spheres or block copolymers can be used to create silica structures with pore sizes ranging from 5 nm to 1 $\mu$m. Nano-porous silica films also can be prepared using a mixture of a solvent and a silica precursor, which is deposited on a substrate. When forming such nano-porous films by spin-coating, the film coating is typically catalyzed with an acid or base catalyst and additional water to cause polymerization or gelation and to yield sufficient strength so that the film does not shrink significantly during drying.

Another method for providing nano-porous silica films was based on the concept that film thickness and density (porosity, or dielectric constant) can be independently controlled by using a mixture of two solvents with dramatically different volatility. The more volatile solvent evaporates during and immediately after precursor deposition. The silica precursor, e.g., partially hydrolyzed and condensed oligomers of tetraethoxysilane (TEOS), is applied to a suitable substrate and polymerized by chemical and/or thermal methods until it forms a gel. The second solvent, called the Pore Control Solvent (PCS) is usually then removed by increasing the temperature until the film is dry. The density or porosity of the final film is governed by the volume ratio of low volatility solvent to silica. It has been found difficult to provide a nano-porous silica film having sufficiently optimized mechanical properties, together with a relatively even distribution of material density throughout the thickness of the film.

Still another method for producing nano-porous inorganic materials is by following the sol-gel techniques, whereby a sol, which is a colloidal suspension of solid particles in a liquid, transforms into a gel due to growth and interconnection of the solid particles. Continued reactions within the sol will lead to a critical chemical state in which one or more molecules within the sol eventually reach macroscopic dimensions so that they form a solid network which extends substantially throughout the sol. At this chemical state, called the gel point, the material begins to become a gel. Hence, a gel may be defined as a substance that contains a continuous solid skeleton enclosing a continuous liquid phase. As the skeleton is porous, the term "gel" as used herein means an open-pored solid structure enclosing a pore fluid. Removal of the pore fluid leaves behind empty pores.

The following publications represent the state-of-the-art of the methods for the preparation of nano-porous films or coatings:

1. O. D. Velev, et al."Porous silica via colloidal crystallization," Nature, 389 (Oct. 1997) 447–448.
2. K. M. Kulinowsky, et al. "Porous metals from colloidal templates," Advanced Materials, 12 (2000) 833.
3. P. R. Coronado, et al., "Method for rapidly producing micro-porous and meso-porous materials," U.S. Pat. No. 5,686,031 (Nov. 11, 1997).
4. S. C. Jha, et al., "Composite porous media," U.S. Pat. No. 6,080,219 (Jun. 27, 2000).
5. M. Moskovits, et al. "Nanoelectric devices," U.S. Pat. No. 5,581,091 (Dec. 3, 1996).
6. R. L. Bedard, et al., "Semiconductor device containing a semiconducting crystalline nanoporous material," U.S. Pat. No. 5,594,263 (Jan. 14, 1997).
7. D. L. Gin, et al., "Highly ordered nanocomposites via a monomer self-assembly in situ condensation approach," U.S. Pat. No. 5,849,215 (Dec. 15, 1998).
8. T. J. Pinnavaia, et al. "Porous inorganic oxide materials prepared by non-ionic surfactant templating route," U.S. Pat. No. 5,622,684 (Apr. 22, 1997).
9. C. J. Brinker, et al., "Method for making surfactant-templated, high-porosity thin films," U.S. Pat. No. 6,270,846 (Aug. 7, 2001).
10. P. J. Bruinsma, et al., "Mesoporous-silica films, fibers, and powders by evaporation," U.S. Pat. No. 5,922,299 (Jul. 13, 1999).
11. R. Leung, et al., "Nanoporous material fabricated using a dissolvable reagent," U.S. Pat. No. 6,214,746 (Apr. 10, 2001).
12. R. Leung, et al., "Low dielectric constant porous films," U.S. Pat. No. 6,204,202 (Mar. 20, 2001).
13. K. Lau, et al., "Nanoporous material fabricated using polymeric template strands," U.S. Pat. No. 6,156,812 (Dec. 5, 2000).
14. S. K. Gordeev, et al., "Method of producing a composite, more precisely nanoporous body and a nanoporous body produced thereby," U.S. Pat. No. 6,083,614 (Jul. 4, 2000).

Despite the availability of previous methods for preparing nano-porous silica films, an urgent need exists for a more general method capable of producing a greater variety of metal compounds and ceramic materials in a thin film or coating form. Furthermore, most of the prior art techniques for the preparation of porous coatings are slow and tedious and, hence, not amenable to mass production.

The present invention has been made in consideration of these problems in the related prior arts, and its object is to provide a cost-effective method for directly forming a nano-porous coating onto a solid substrate. In order to produce a uniform, thin, and nano-porous metal compound or ceramic coating on a substrate, it is essential to produce depositable clusters that are on the nanometer scale prior to striking the substrate. These clusters must be capable of partially adhering to each other through parting sintering, liquid bonding, and/or vapor bonding between clusters.

In one embodiment of the present invention, a method entails producing ultra-fine clusters of metal compound or ceramic species and directing these clusters to impinge upon a substrate, permitting these clusters to become solidified thereon to form a thin coating layer. These nano clusters are produced by operating a twin-wire arc nozzle in a chamber to produce metal vapor clusters and by introducing a reactive gas (e.g., oxygen) into the chamber to react with the metal clusters, thereby converting these metal clusters into nanometer-sized ceramic (e.g., oxide) clusters. The heat generated by the exothermic oxidation reaction can in turn accelerate the oxidation process and, therefore, make the process self-sustaining or self-propagating. The great amount of heat released can also help to maintain the resulting oxide clusters in the vapor, liquid, and/or high-temperature solid state. Rather than cooling and collecting these clusters to form individual powder particles, these nanometer-sized vapor clusters can be directed to form an ultra-thin oxide coating onto a solid substrate.

SUMMARY OF THE INVENTION

A preferred embodiment of the present invention is a method for producing an optically transparent and electrically conductive coating onto a substrate. The method includes three primary steps: (a) operating a twin-wire arc nozzle to provide a stream of nano-sized metal vapor clusters into a coating chamber in which the substrate is disposed; (b) introducing a stream of oxygen-containing gas into this chamber to impinge upon the stream of metal vapor clusters and exothermically react therewith to produce substantially nanometer-sized metal oxide clusters; and (c) directing these metal oxide clusters to deposit onto the substrate for forming the desired coating.

In the first step, the method begins with feeding a pair of metal wires (either a pure metal or metal alloy) into the upper portion of a coating chamber. The respective leading tips of the two wires are first brought to be in physical contact with each other to form a tentative "short circuit" under a high-current condition and, with the presence of a working gas, form an ionized arc. The arc will heat and vaporize the tips to form nano-sized metal clusters. While the wire tips are being consumed by the arc, the wires are continuously or intermittently fed into an arc cell so that the two leading tips are maintained at a relatively constant separation in a working gas environment. An oxygen-containing gas is introduced into the chamber to react with the metal vapor clusters to form metal oxide clusters. In this case, the oxygen-containing gas serves to provide the needed oxygen for initiating and propagating the exothermic oxidation reaction to form the oxide clusters in the liquid or vapor state, which are then deposited onto the substrate to form a thin coating.

The twin-wire arc spray process, originally designed for the purpose of thermal spray coating, can be adapted for providing a continuous stream of metal vapor clusters. This is a low-cost process that is capable of readily heating up the metal wire to a temperature as high as 6,000° C. In an electric arc, the metal is rapidly heated to an ultra-high temperature and is vaporized essentially instantaneously. Since the wires can be continuously fed into the arc-forming cell, the arc vaporization is a continuous process, which means a high coating rate.

The presently invented method is applicable to essentially all metallic materials, including pure metals and metal alloys. When high service temperatures are not required, the metal may be selected from the low melting point group consisting of antimony, bismuth, cadmium, cesium, gallium, indium, lead, lithium, rubidium, selenium, tin, and zinc. When a high service temperature is required, a metallic element may be selected from the high-melting refractory group consisting of tungsten, molybdenum, tantalum, hafnium and niobium. Other metals with intermediate melting points such as copper, zinc, aluminum, iron, nickel and cobalt may also be selected. Indium, tin, zinc, and antimony are currently the preferred choices of metal for practicing the present invention for liquid crystal display applications.

Preferably the reactive gas is an oxygen-containing gas, which includes oxygen and, optionally, a predetermined amount of a second gas selected from the group consisting of argon, helium, hydrogen, carbon, nitrogen, chlorine, fluorine, boron, sulfur, phosphorus, selenium, tellurium, arsenic and combinations thereof. Argon and helium are noble gases and can be used as a carrier gas (without involving any chemical reaction) or as a means to regulate the oxidation rate. Other gases may be used to react with the metal clusters to form compound or ceramic phases of hydride, oxide, carbide, nitride, chloride, fluoride, boride, sulfide, phosphide, selenide, telluride, and arsenide in the resulting coating if so desired.

Specifically, if the reactive gas contains oxygen, this reactive gas will rapidly react with the metal clusters to form nanometer-sized ceramic clusters (e.g., oxides). If the reactive gas contains a mixture of two or more reactive gases (e.g., oxygen and nitrogen), the resulting product will contain a mixture of oxide and nitride clusters. If the metal composition is a metal alloy or mixture (e.g., containing both indium and tin elements) and the reactive gas is oxygen, the resulting product will contain ultra-fine indium-tin oxide clusters that can be directed to deposit onto a glass or plastic substrate.

At a high arc temperature, metal clusters are normally capable of initiating a substantially spontaneous reaction with a reactant species (e.g., oxygen). In this case, the reaction heat released is effectively used to sustain the reactions in an already high temperature environment.

Still another preferred embodiment is a system for producing an optically transparent, electrically conductive coating onto a substrate. The system includes (a) a coating chamber to accommodate the substrate, (b) a twin-wire electrode device in supplying relation to the coating chamber for supplying nano-scaled clusters of a metal composition therein. The electrode device includes:

(i) two wires made up of this metal composition, with each wire having a leading tip which is continuously or intermittently fed into the coating chamber in such a fashion that the two leading tips are maintained at a desired separation; and (ii) means for providing electric currents and a working gas flow for creating an ionized arc between the two leading tips for melting and vaporizing the metal composition to generate the nano-scaled metal clusters; ;

(c) gas supply means disposed a distance from the chamber for supplying a reactive gas into the chamber to react with the nano-scaled clusters therein for forming substantially nanometer-sized metal compound or ceramic clusters; and (d) supporting-conveying means to support and position the substrate into the chamber, permitting the metal compound or ceramic clusters to deposit and form a coating onto the substrate. Preferably, the supporting-conveying means are made to be capable of transferring, intermittently or continuously, a train of substrate glass pieces into the deposition chamber for receiving the depositable oxide clusters and then transferring them out of the chamber once a coating of a desired thickness is deposited on the substrate.

Advantages of the present invention are summarized as follows:

1. A wide variety of metallic elements can be readily converted into nanometer-scaled oxide clusters for deposition onto a glass or plastic substrate. The starting metal materials can be selected from any element in the periodic table that is considered to be metallic. In addition to oxygen, partner gas species may be selected from the group consisting of hydrogen, carbon, nitrogen, chlorine, fluorine, boron, sulfur, phosphorus, selenium, tellurium, arsenic and combinations thereof to help regulate the oxidation rate and, if so desired, form respectively metal hydrides, oxides, carbides, nitrides, chlorides, fluorides, borides, sulfides, phosphide, selenide, telluride, arsenide and combinations thereof. No known prior-art technique is so versatile in terms of readily producing so many different types of ceramic coatings on a substrate.
2. The metal composition can be an alloy of two or more elements which are uniformly dispersed. When broken up into nano-sized clusters, these elements remain uniformly dispersed and are capable of reacting with oxygen to form uniformly mixed ceramic coating, such as indium-tin oxide. No post-fabrication mixing treatment is necessary.
3. The twin wires can be fed into the arc cell at a high rate with their leading tips readily vaporized. This feature makes the method fast and effective and now makes it possible to mass produce transparent and conductive coatings on a substrate cost-effectively.
4. The system needed to carry out the invented method is simple and easy to operate. It does not require the utilization of heavy and expensive equipment such as a laser or vacuum-sputtering unit. In contrast, it is difficult for a method that involves a high vacuum to be a continuous process. The over-all product costs produced by the presently invented vacuum-free method are very low.

DETAILED DESCRIPTION OF PREFERRED EMBODIMENTS

Figure 1:
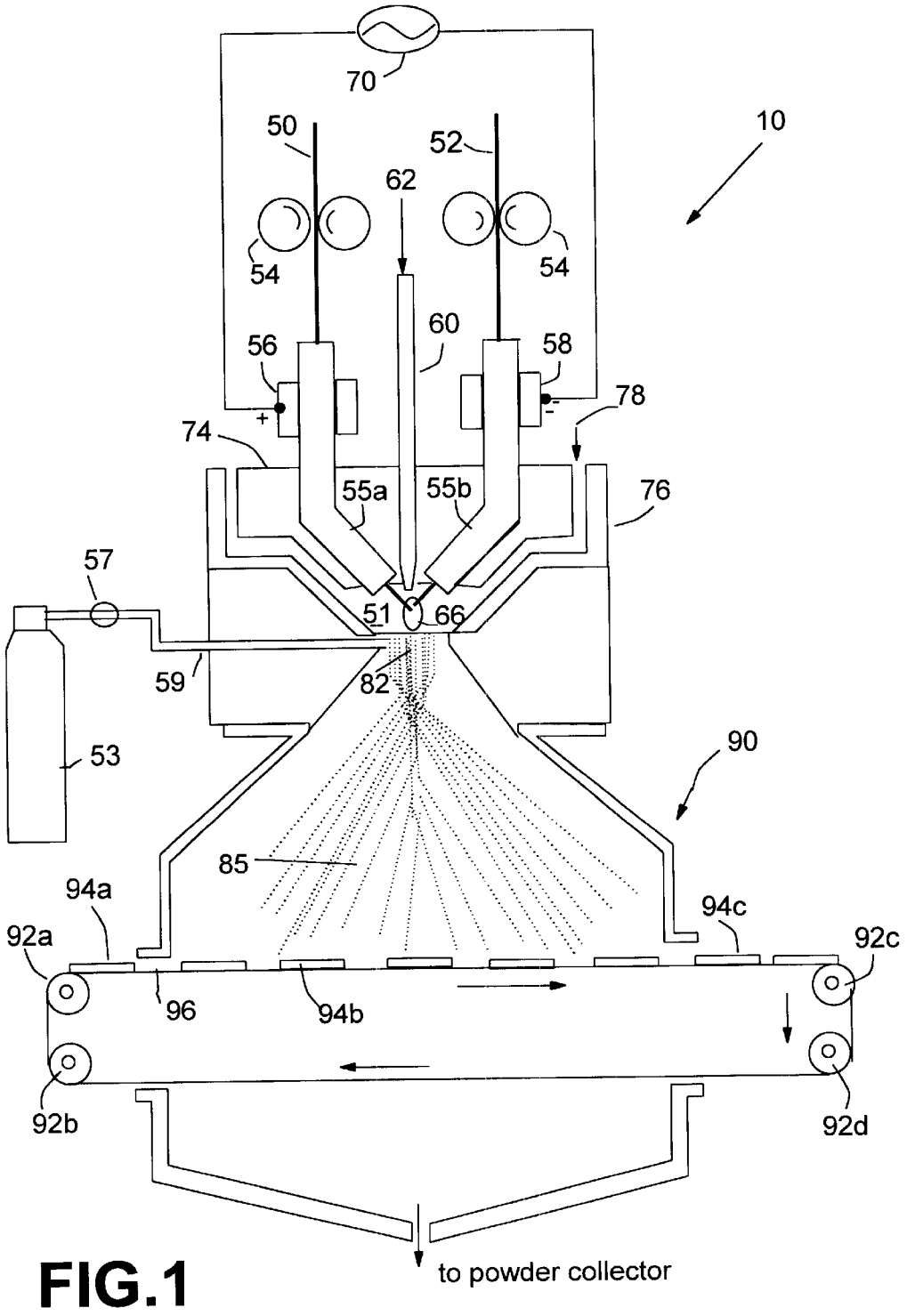
FIG. 1 show the schematic of a preferred embodiment of a system for producing oxide coating on a substrate.

FIG. 1 schematically shows a coating system, in accordance with a preferred embodiment of the present invention, for producing an optically clear and electrically conductive coating on a glass or plastic substrate. This apparatus includes four major functional components: (1) a coating chamber 90, (2) a twin-wire arc nozzle means 10, (3) reactive gas-supplier (e.g., a gas bottle 53 supplying a reactive gas through a valve 57 and pipe means 59 into a location inside the chamber downstream from the ionized arc 66), and (4) substrate supporter-conveyor (e.g., conveying rollers 92*a*, 92*b*, 92*c*, 92*d* and belt 96).

In a preferred embodiment of the presently invented system, as indicated in FIG. 1, the twin-wire electric arc spray nozzle is mainly composed of an electrically insulating block 74, two feed wires 50, 52, a working gas passage means 60, and a secondary gas nozzle with a gas passage 78. The two metal wires 50,52 are supplied with a direct-current (DC) voltage (one "+" and the other "−") or a pulsed power 70 to form an arc 66 in an arc chamber 51. This arc 66, being at an ultra-high temperature (up to 6,000° C.), functions to melt and vaporize the wire tips to generate nano-sized metal vapor clusters. A stream of working/carrier gas from a source 62 (not shown; denoted by an arrow) passes through the passage means 60 into the arc chamber 51 to help maintain the ionized arc and to carry the stream of metal vapor clusters downward toward lower portion of the coating chamber 90.

The two wires 50,52 can be fed through air-tight means 55*a*, 55*b* into the arc cell 51, continuously or intermittently on demand, by a wire-feeding device (e.g., powered rollers 54). The wire feeding speed of the powered rollers may be varied by varying the rotational speed of the controlling motor. An optional secondary gas nozzle (having a gas passage 78) can be used to further increase the arc temperature, providing a stream of super-heated fine metal vapor clusters into the coating chamber 90.

A reactive gas such as an oxygen-containing gas provided from a gas cylinder 53 goes through a valve 57 and tubing 59 into a location 82 downstream from the ionized arc 66 inside the coating chamber. The oxygen gas impinges upon the metal clusters to initiate and sustain an exothermic oxidation reaction between oxygen and metal clusters, thereby converting the ultra-fine metal clusters into depositable metal oxide clusters 85 that are in the liquid or, preferably, vapor state.

The ultra-fine oxide clusters 85 are then directed to deposit onto a glass or plastic substrate (e.g., 94*b*) being supported by a conveyor belt 96 which is driven by 4 conveyor rollers 92*a*–92*d*. The lower portion of FIG. 1 shows a train of substrate glass pieces, including 94*a* (uncoated), 94*b* (being coated) and 94*c* (coated). The oxide clusters that are not deposited will be cooled to solidify and become solid powder particles. These powder particles, along with the residual working gas and carrier gas, are transferred through a conduit to an optional powder collector/separator system (not shown).

The twin-wire arc spray nozzle, originally developed for use in a conventional thermal spray coating process, can be adapted for providing a continuous stream of super-heated metal vapor clusters. This low-cost device, capable of readily heating up the metal wire to a temperature as high as 6,000° C., is further illustrated in FIG. 2*a* and 2*b*.

Figure 2A:
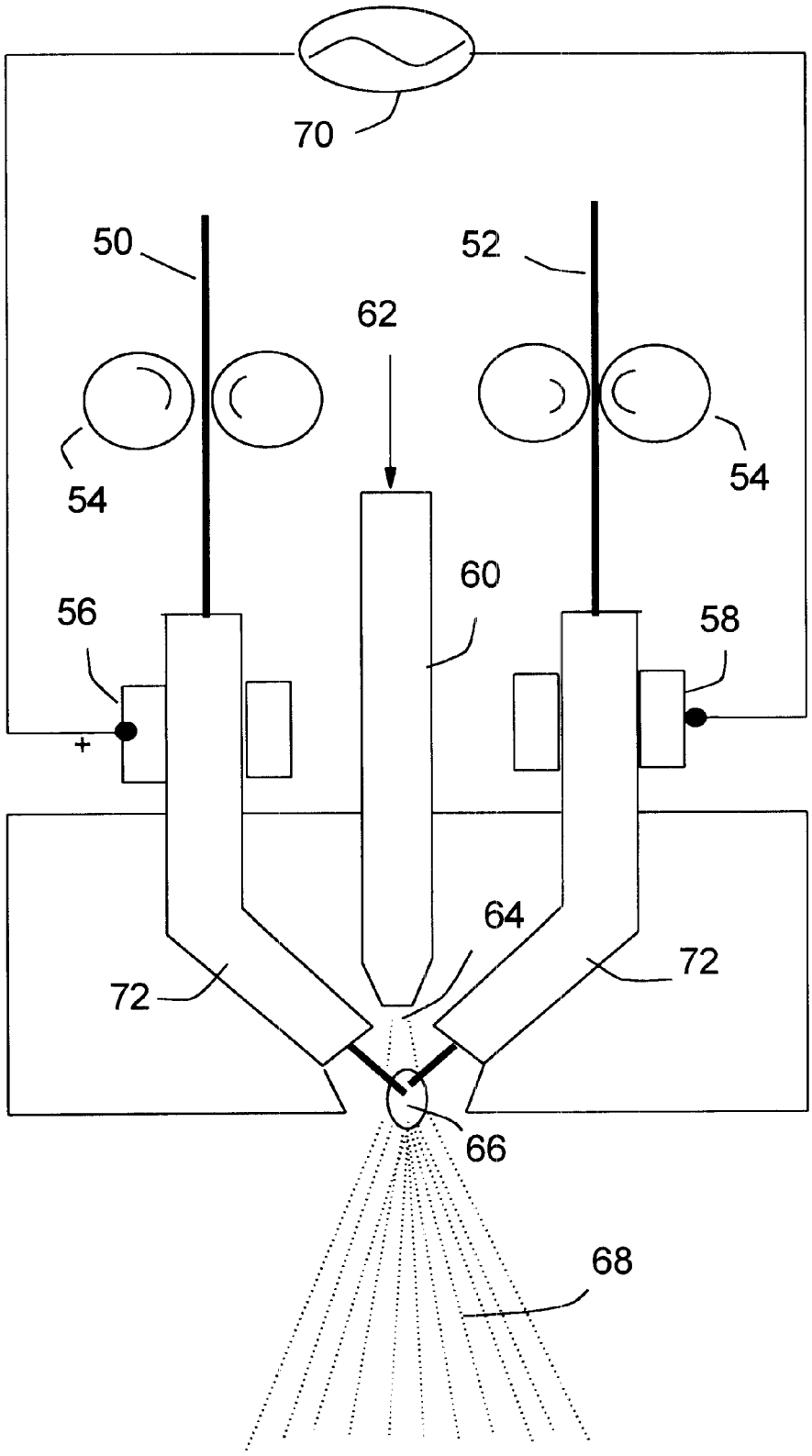
FIGS. 2*a* and 2*b* schematically show the working principle of an electric arc spray-based device for generating a stream of nano-sized metal vapor clusters: (a) an open-style arc-spray nozzle and (b) a closed-style arc-spray nozzle in which the arc zone is enclosed by an air cap 76.

Schematically shown in FIG. 2*a* is an open-style twin-wire arc spray nozzle. Two metal wires 50,52 are driven by powered rollers 54 to come in physical contact with two respective conductive jackets 72 which are supplied with "+" and "−" voltage or pulsed power through electrically conductive blocks 56 and 58, respectively. The voltage polarity may be reversed; i.e., "−" and "+" instead of "+" and "−". The voltages may come from either a DC or a pulsed power source 70. The lower ends of the two wires approach each other at an angle of approximately 30–60°. The two ends are brought to contact each other for a very brief period of time. Such a "short circuit" contact creates an ultra-high temperature due to a high current density, leading to the formation of an arc 66. A stable arc can be maintained provided that the voltage is constantly supplied, a certain level of gas pressure is maintained, and the wires are fed at a constant or pulsating speed. A stream 64 of compressed air, introduced through a gas passage 60 from a gas source (e.g., compressed air bottle, not shown), serves to provide such a working gas, which also helps to carry the metal clusters downward toward the substrate. The system may further include means for providing dissociable inert gas mixable with the working gas, the dissociable inert gas increasing the temperature gradient in the ionized arc.

Figure 2B:
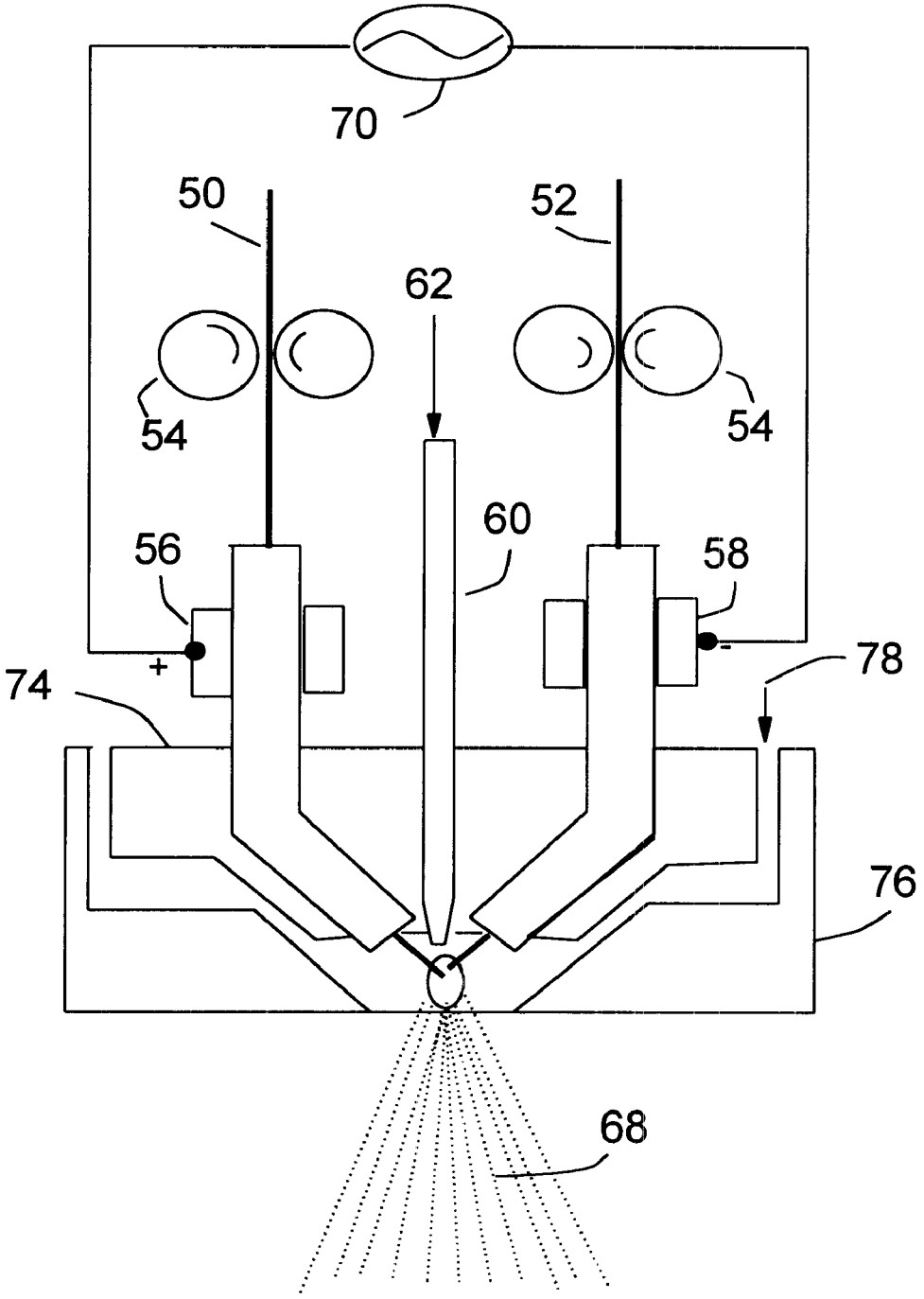

A closed-style arc spray nozzle is schematically shown in FIG. 2*b*. In this spray arc nozzle, the arc zone is enclosed by an air cap 76 and additional compressed gas or air (referred to as the secondary gas) is introduced (e.g., from 78) into the arc zone to compress the arc. The increased arc zone pressure effectively increases the arc temperature, thereby promoting the more efficient metal vaporization and finer metal vapor clusters. These super-heated fine vapor clusters (e.g., 68) are then carried into the coating chamber for reaction with oxygen to form oxide clusters.

Twin-arc spray nozzles have been advanced to the extent that they provide reliable and stable ultra-high temperature arcs. These low cost devices are available from several commercial sources. Examples of these devices can be found in the following patents: U.S. Pat. No. 4,095,081 (Jun. 13, 1978 to S. J. Ashman), U.S. Pat. No. 4,668,852 (May 26, 1987 to T. J. Fox, et al.), and U.S. Pat. No. 5,964,405 (Oct. 12, 1999 to R. Benary, et al.).

In another embodiment of the invented system, the two wires are made up of two different materials so that a mixture of two types of nano clusters can be produced for the purpose of depositing a hybrid or composite coating material.

Figure 3:
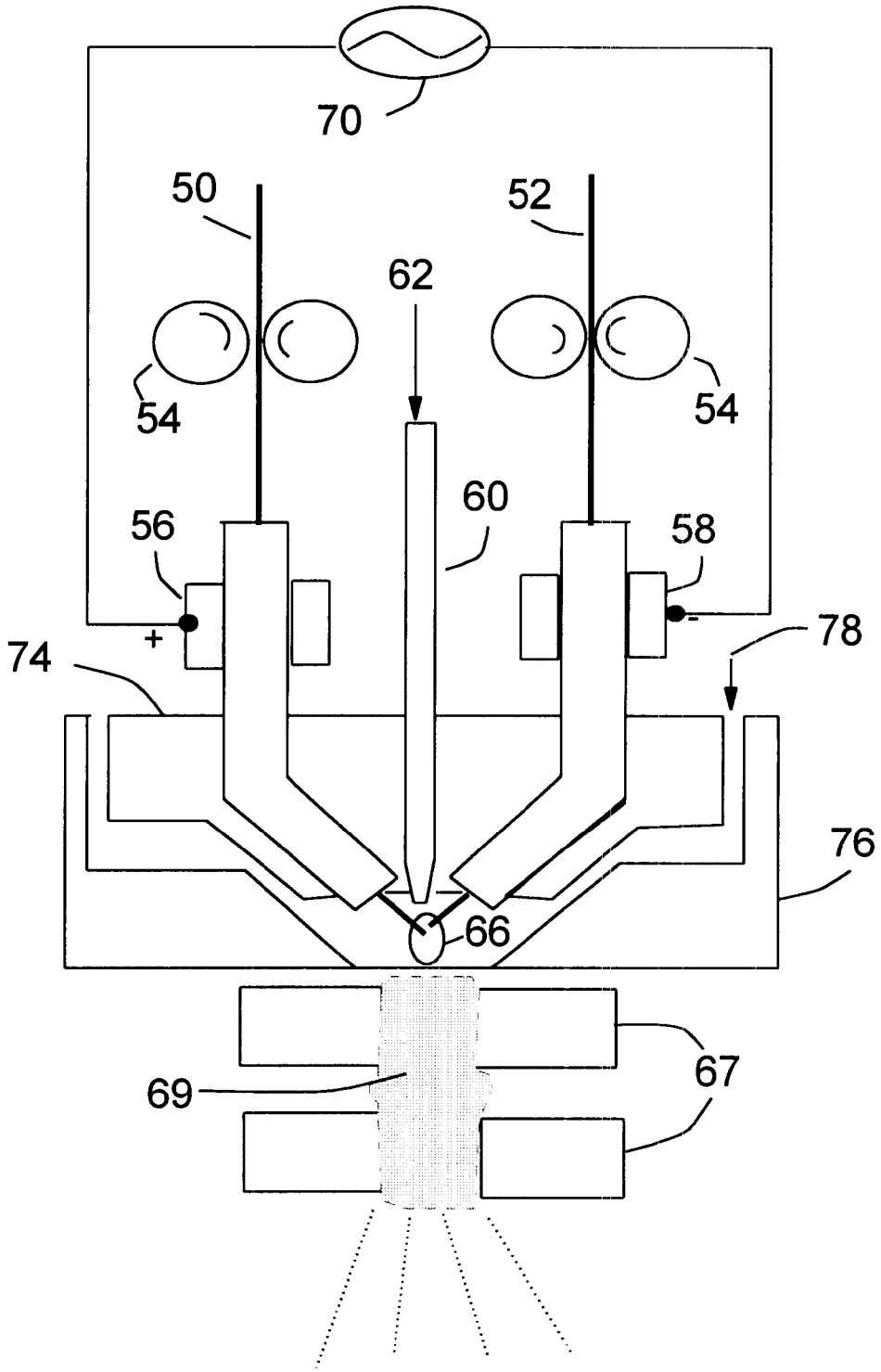
FIG. 3 the twin-wire arc nozzle further equipped with a plasma arc device for generating a plasma arc zone downstream from the twin-wire arc..

In a preferred embodiment, the system (for both cases of two wires of the same material and of different materials) as defined above may further include a second plasma arc zone below the ionized arc between the two wire tips to vaporize any un-vaporized material dripped therefrom. For instance, a plasma arc device (e.g., with electrodes 67 in FIG. 3) may be utilized to generate a plasma arc zone 69 through which the un-vaporized melt droplets dripped out of the ionized arc 66 will have another chance to get vaporized. The creation of a plasma arc zone is well-known in the art. The ultra-high temperature in the plasma arc (up to as high as 32,000° K.) rapidly vaporizes the melt droplets that pass through the plasma arc zone.

For the purpose of clearly defining the claims, the word "wire" means a wire of any practical diameter, e.g., from several microns (a thin wire or fiber) to several centimeters (a long, thick rod). A wire can be supplied from a spool, which could provide an uninterrupted supply of a wire as long as several miles. This is a very advantageous feature, since it makes the related coating process a continuous one.

The presently invented system is applicable to essentially all metallic materials (including pure metals and metal alloys), metal compounds, and ceramic materials. As used herein, the term "metal" refers to an element of Groups 2 through 13, inclusive, plus selected elements in Groups 14 and 15 of the periodic table. Thus, the term "metal" broadly refers to the following elements:

Group 2 or IIA: beryllium (Be), magnesium (Mg), calcium (Ca), strontium (Sr), barium (Ba), and radium (Ra).

Groups 3–12: transition metals (Groups IIIB, IVB, VB, VIB, VIIB, VIII, IB, and IIB), including scandium (Sc), yttrium (Y), titanium (Ti), zirconium (Zr), hafnium (Hf), vanadium (V), niobium (Nb), tantalum (Ta), chromium (Cr), molybdenum (Mo), tungsten (W), manganese (Mn), technetium (Tc), rhenium (Re), iron (Fe), ruthenium (Ru), osmium (Os). cobalt (Co), rhodium (Rh), iridium (Ir), nickel (Ni), palladium (Pd), platinum (Pt), copper (Cu), silver (Ag), gold (Au), zinc (Zn), cadmium (Cd), and mercury (Hg).

Group 13 or IIIA: boron (B), aluminum (Al), gallium (Ga), indium (In), and thallium (Tl).

Lanthanides: lanthanum (La), cerium (Ce), praseodymium (Pr), neodymium (Nd), promethium (Pm), samarium (Sm), europium (Eu), gadolinium (Gd), terbium (Th), dysprosium (Dy), holmium (Ho), erbium (Er), thulium (Tm), ytterbium (Yb), and lutetium (Lu).

Group 14 or IVA: germanium (Ge), tin (Sn), and lead (Pb).

Group 15 or VA: antimony (Sn) and bismuth (Bi).

When high service temperatures are not required, the component metal element may be selected from the low melting point group consisting of bismuth, cadmium, cesium, gallium, indium, lead, lithium, rubidium, tin, and zinc, etc. When a high service temperature is required, a metallic element may be selected from the high-melting refractory group consisting of tungsten, molybdenum, tantalum, hafnium and niobium. Other metals with intermediate melting points such as copper, zinc, aluminum, iron, nickel and cobalt may also be selected. However, for the purpose of producing optically transparent and electrically conductive coating, indium, tin, antimony, and zinc are the most preferred metallic elements.

Preferably the reactive gas includes a gas selected from the group consisting of hydrogen, oxygen, carbon, nitrogen, chlorine, fluorine, boron, iodine, sulfur, phosphorus, arsenic, selenium, tellurium and combinations thereof. Noble gases such as argon and helium may be used to adjust or regulate the oxidation rate. Other gases may be used to react with the metal clusters to form nanometer-scale compound or ceramic powders of hydride, oxide, carbide, nitride, chloride, fluoride, boride, iodide, sulfide, phosphide, arsenide, selenide, and telluride, and combinations thereof.

If the reactive gas contains a reactive gas (e.g., oxygen), this reactive gas will rapidly react with the metal clusters to form nanometer-sized ceramic clusters (e.g., oxides). If the reactive gas contains a mixture of two or more reactive gases (e.g., oxygen and nitrogen), the resulting product will contain a mixture of two compounds or ceramics (e.g., oxide and nitride). If the metal wire is a metal alloy or mixture (e.g., containing both indium and tin elements) and the reactive gas is oxygen, the resulting product will contain ultra-fine indium-tin oxide particles.

Another embodiment of the present invention is a method for producing an optically transparent and electrically conductive coating onto a transparent substrate. The method includes three steps:

(a) operating a twin-wire arc nozzle to heat and at least partially vaporize two wires of a metal composition for providing a stream of nanometer-sized metal vapor clusters into a chamber in which the substrate to be coated is disposed;

(b) introducing a stream of oxygen-containing gas into this chamber to impinge upon this stream of metal vapor clusters and exothermically react therewith to produce substantially nanometer-sized metal oxide clusters (in liquid or vapor state, preferably vapor state); and (c) directing the metal oxide clusters to deposit onto the substrate for forming the coating.

Optionally, the method may include another step of operating a plasma arc means for vaporizing any un-vaporized metal after step (a) and before step (b). Also optionally, the method may include an additional step of operating a plasma arc means for vaporizing any un-vaporized metal oxide clusters after step (b) and before step (c).

In the presently invented method, the stream of reactive gas or oxygen-containing gas may further include a small amount of a second gas to produce a small proportion of compound or ceramic clusters that could serve to modify the properties of the otherwise pure oxide coating. This second gas may be selected from the group consisting of hydrogen, carbon, nitrogen, chlorine, fluorine, boron, sulfur, phosphorus, arsenic, selenium, tellurium and combinations thereof.

Preferably, the transparent substrate in the practice of the present method includes a train of individual pieces of glass or plastic being moved sequentially or concurrently into coating chamber and then moved out of the chamber after the coating is formed. This feature will make the process a continuous one.

In another embodiment of the method, the metal composition may include an alloy or mixture of at least two metallic elements, with a primary one occupying more than 95% and the minor one less than 5% by atomic number. The primary one is selected so that its metal vapor clusters can be readily converted to become oxides or other ceramic clusters. However, the minor one may be allowed to remain essentially as nano-sized metal clusters. Upon deposition onto the substrate, the minor metal element only serves as a modifier to the properties (e.g., to increase the electrical conductivity) of the oxide coating. The presence of a small amount of nano-scaled metal domains does not adversely affect the optical transparency of the oxide coating.

In the presently invented method, the stream of oxygen-containing gas reacts with the metal vapor clusters in such a manner that the reaction heat released is used to sustain the reaction until most of the metal vapor clusters are substantially converted to nanometer-sized oxide clusters. The stream of oxygen-containing gas may be pre-heated to a predetermined temperature prior to being introduced to impinge upon the metal vapor clusters. A higher gas temperature promotes or accelerates the conversion of metallic clusters to compound or ceramic clusters.

What is claimed:

1. A method for producing a nano-porous coating onto a solid substrate, said method comprising:

(a) operating twin-wire arc nozzle means to heat and at least partially vaporize two wires of a metal composition for providing a stream of nanometer-sized vapor clusters of said metal composition into a chamber in which said substrate is disposed;

(b) injecting a stream of reactive gas into said chamber to impinge upon said stream of metal vapor clusters and exothermically react therewith to produce substantially nanometer-sized metal compound or ceramic clusters;

(c) operating heat treatment means to heat treat said metal compound or ceramic clusters so that a non-zero proportion of said clusters is in a solid state when impinging upon said substrate; and (d) directing said metal compound or ceramic clusters to impinge and deposit onto said substrate for forming said nano-porous coating.

2. The method as set forth in claim 1, wherein said stream of reactive gas comprises a gas selected from the group consisting of hydrogen, oxygen, carbon, nitrogen, chlorine, fluorine, boron, sulfur, phosphorus, selenium, tellurium, arsenic and combinations thereof.

3. The method as set forth in claim 1, wherein said stream of reactive gas reacts with said metal vapor clusters in such a manner that the reaction heat released is used to sustain the reaction until most of said metal vapor clusters are substantially converted to nanometer-sized metal compound or ceramic clusters.

4. The method as set forth in claim 1, wherein said stream of reactive gas is pre-heated to a predetermined temperature prior to being injected to impinge upon said metal vapor clusters.

5. A method for producing a nano-porous metallic coating onto a solid substrate, said method comprising:

(a) operating twin-wire arc nozzle means to heat and at least partially vaporize two wires of a metal composition for providing a stream of nanometer-sized vapor clusters of said metal composition into a chamber in which said substrate is disposed;

(b) operating heat treatment means to heat treat said metal clusters so that a non-zero proportion of said metal clusters is in a solid state when impinging upon said substrate; and (c) directing said metal clusters to impinge and deposit onto said substrate for forming said nano-porous metallic coating.

6. The method as set forth in claim 1 or 5 , wherein said step of operating heat treatment means includes a step of injecting a stream of cool gas to impinge upon said vapor clusters.

7. The method as set forth in claim 1 or 5, wherein said substrate comprises a train of individual pieces of solid substrate material being moved sequentially or concurrently into said chamber and then moved out of said chamber after said coating is formed.

8. The method as set forth in claim 1 or 5, wherein said metal composition comprises an alloy of at least two metallic elements.

9. The method as set forth in claim 1 or 5, further comprising a step of operating a separate plasma arc means for vaporizing any un-vaporized metal after step (a) and before step (b).

10. The method as set forth in claim 1 or 5, wherein said metal composition comprises at least one metallic element selected from the low melting point group consisting of bismuth, cadmium, antimony, cesium, gallium, indium, lead, lithium, rubidium, tin, and zinc.

11. The method as set forth in claim 1 or 5, wherein said non-zero proportion of solid clusters are at a temperature sufficient to cause partial sintering between said solid clusters.

12. The method as set forth in claim 1 or 5, wherein the step of operating heat treatment means is carried out in such a fashion that said clusters are a mixture of solid clusters and liquid clusters.

13. The method as set forth in claim 1 or 5, wherein the step of operating heat treatment means is carried out in such a fashion that said clusters are a mixture of solid, liquid, and vapor clusters.

14. The method as defined in claim 1 or 5, wherein the step of operating twin-wire arc nozzle means to heat and at least partially vaporize two wires of a metal composition includes the sub-steps of melting the wires and atomizing the resulting metal melt to form nanometer-scaled liquid droplets of said metal composition, said liquid droplets becoming mixed with said stream of metal vapor clusters.

15. The method as defined in claim 14, wherein said liquid droplets react with said reactive gas to form nano-scaled metal compound or ceramic clusters.

* * * * *